US007466955B2

(12) United States Patent
Konishi

(10) Patent No.: US 7,466,955 B2
(45) Date of Patent: Dec. 16, 2008

(54) TONER DELIVERY MECHANISM MADE IN SIMPLE CONSTRUCTION AND IMAGE FORMING DEVICE

(75) Inventor: Hirohito Konishi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 367 days.

(21) Appl. No.: 11/306,863

(22) Filed: Jan. 13, 2006

(65) Prior Publication Data

US 2006/0198674 A1 Sep. 7, 2006

(30) Foreign Application Priority Data

Jan. 14, 2005 (JP) ..... 2005-008079

(51) Int. Cl.
*G03G 21/00* (2006.01)

(52) U.S. Cl. ..... 399/358

(58) Field of Classification Search ..... 399/358, 399/360

See application file for complete search history.

(56) References Cited

U.S. PATENT DOCUMENTS 5,113,227 A * 5/1992 Miyasaka ..... 399/358
5,634,172 A * 5/1997 Manab ..... 399/35
7,333,763 B2 * 2/2008 Choi ..... 399/358

FOREIGN PATENT DOCUMENTS

JP 2002/14587 A 1/2002

* cited by examiner

*Primary Examiner*—William J Royer
(74) *Attorney, Agent, or Firm*—Global IP Counselors, LLP

(57) ABSTRACT

A toner delivery mechanism is arranged between a cleaning device and a toner collection receptacle, and includes a collection pipe for delivering toner from the cleaning device to the toner collection receptacle, and a collection spiral that extends into the collection pipe and rotates. The collection spiral is formed to reciprocate in the toner delivery direction in conjunction with the rotational drive thereof.

12 Claims, 10 Drawing Sheets

TONER DELIVERY MECHANISM MADE IN SIMPLE CONSTRUCTION AND IMAGE FORMING DEVICE

BACKGROUND OF THE INVENTION

1. Field of the Invention

The present invention relates to an image forming device. The present invention further relates to a toner delivery mechanism, and more specifically to a toner delivery mechanism used in an image forming device such as a copying machine, printer, facsimile, and so forth of a type that transfers an applied toner image to recording paper.

2. Background Information

An image forming device that develops an electrostatic latent image into a toner image and transfers the applied toner image to recording paper comprises an image forming means in a predetermined location within a housing. The image forming means normally comprises a developing device and a cleaning device in addition to a photoreceptor acting as an image carrier means. The electrostatic latent image is formed on the image carrier means through an appropriate method, and the applied electrostatic latent image is developed into a toner image by the operation of the developing device. Next, the toner image is transferred to a recording sheet such as a standard paper sheet, and the residual toner on the image carrier means is removed thereafter by the operation of the cleaning device.

The cleaning device generally has a toner collection receptacle attached through a toner delivery mechanism, where the toner removed from the image carrier means can be collected into a toner collection receptacle after being delivered by the toner delivery mechanism. The toner delivery mechanism is constructed from, for instance, a long and thin collection pipe that extends to deliver toner from the cleaning device to the toner collection receptacle, and a collection spiral consisting of metal coil members that extend within the collection spiral and rotate.

When a sufficient amount of toner is not in the collection pipe with this type of toner delivery mechanism, a very loud noise is generated by the collection spiral scraping against the inner wall surface of the collection pipe when the collection spiral extended within the collection pipe is rotated. This noise is reduced when a sufficient amount of toner is in the collection pipe, with the toner functioning as a lubricating agent.

The conventional counter to this calls for forming the collection spiral from, for example, synthetic rubber with a hardness of 50 to 70 on the type A hardness test using a spring regulated to Japanese Industrial Standard JIS-K-630 (see Japanese Patent Application Publication No. 2002-14587).

According to the construction described in the above publication, forming the collection spiral from synthetic rubber is preferred in order to sufficiently control the generation of noise, even before sending a sufficient amount of toner into the collection pipe.

However, according to the construction described in the above publication, the collection spiral cannot avoid always being in contact with the same part of the inner wall surface of the collection pipe when rotating, regardless of whether there is toner in the collection pipe. More specifically, if a portion of the collection pipe is curved, that portion of the collection pipe may become damaged through extended use when the collection spiral contacts with the same part of the inner wall surface at the curved portion when rotating.

SUMMARY OF THE INVENTION

An object of the present invention is to provide a toner delivery mechanism capable of a long lifespan and having a simple construction, and an image forming device comprising such toner delivery mechanism.

A toner delivery mechanism according to a first aspect of the present invention is arranged between a cleaning device that cleans residual toner on an image carrier and a toner collection receptacle that collects the residual toner, and comprises a collection pipe, a collection spiral, rotation drive means, and reciprocating means. The collection pipe is arranged between the cleaning device and the toner collection receptacle. The collection spiral extends into the collection pipe and delivers the toner by rotating. The rotation drive means rotates the collection spiral. The reciprocating means reciprocates the collection spiral in the toner delivery direction.

The toner collected by the cleaning device is delivered to the toner collection receptacle by the collection spiral within the collection pipe with this mechanism. At this time, the collection spiral reciprocates while rotating.

The collection spiral does not come into contact with the same part of the inner wall surface of the collection pipe, because it reciprocates while rotating in the toner delivery direction. The fear of damaging a specific part of the collection pipe, as with the conventional method, is therefore alleviated, thereby enabling a longer life span to be provided for the toner delivery mechanism. Further convenience is possible, as considerations do not have to be made for the shape of the collection pipe, and the placement of the cleaning device and the toner collection receptacle, because a longer life span can be provided, even when there is a curved portion in the collection pipe between the cleaning device and the toner collection receptacle.

A toner delivery mechanism according to a second aspect of the present invention is the toner delivery mechanism of the first aspect, wherein the reciprocating means reciprocates the collection spiral in conjunction with the rotation of the collection spiral by means of the rotation drive means.

The collection spiral is reciprocated in conjunction with such rotation. In other words, the constriction is extremely simple, and causes the collection spiral to reciprocate in the toner delivery direction with drive rotation.

A toner delivery mechanism according to a third aspect of the present invention is the toner delivery mechanism according to the second aspect, and further comprises a single drive unit for storing the rotation drive means and the reciprocating means.

A toner delivery mechanism according to a fourth aspect of the present invention is the toner delivery mechanism according to the third aspect, wherein the reciprocating means comprises a cam and a shaft. The cam has a tilted surface that tilts in the toner delivery direction of the collection spiral. The shaft is connected to the collection spiral, and has the ability to reciprocate in the toner delivery direction of the collection spiral by contacting the tilted surface of the cam.

The shaft reciprocates by means of the rotation of the cam, and the collection spiral reciprocates by means of the reciprocating action of the shaft.

An image device according to a fifth aspect of the present invention comprises an image forming unit, a paper supply unit, a cleaning device, a toner collection receptacle, and a toner delivery mechanism. The image forming unit has an image carrier on the surface of which a toner image can be formed, and which forms a toner image on paper. The paper supply unit supplies paper to the image forming unit. The cleaning device cleans the residual toner on the image carrier. The toner collection receptacle collects the residual toner collected by the cleaning device. The toner delivery mechanism is arranged between the cleaning device and the toner collection receptacle, and comprises a collection pipe, a collection spiral, rotation drive means, and reciprocating means. The collection pipe is arranged between the cleaning device and the toner collection receptacle. The collection spiral extends within the collection pipe and delivers toner by rotation. The rotation drive means rotates the collection spiral. The reciprocating means reciprocates the collection spiral in the toner delivery direction.

An image forming device according to a sixth aspect of the present invention is the image forming device according to the fifth aspect, wherein the reciprocating means reciprocates the collection spiral in conjunction with the rotation of the collection spiral by means of the rotation drive means.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
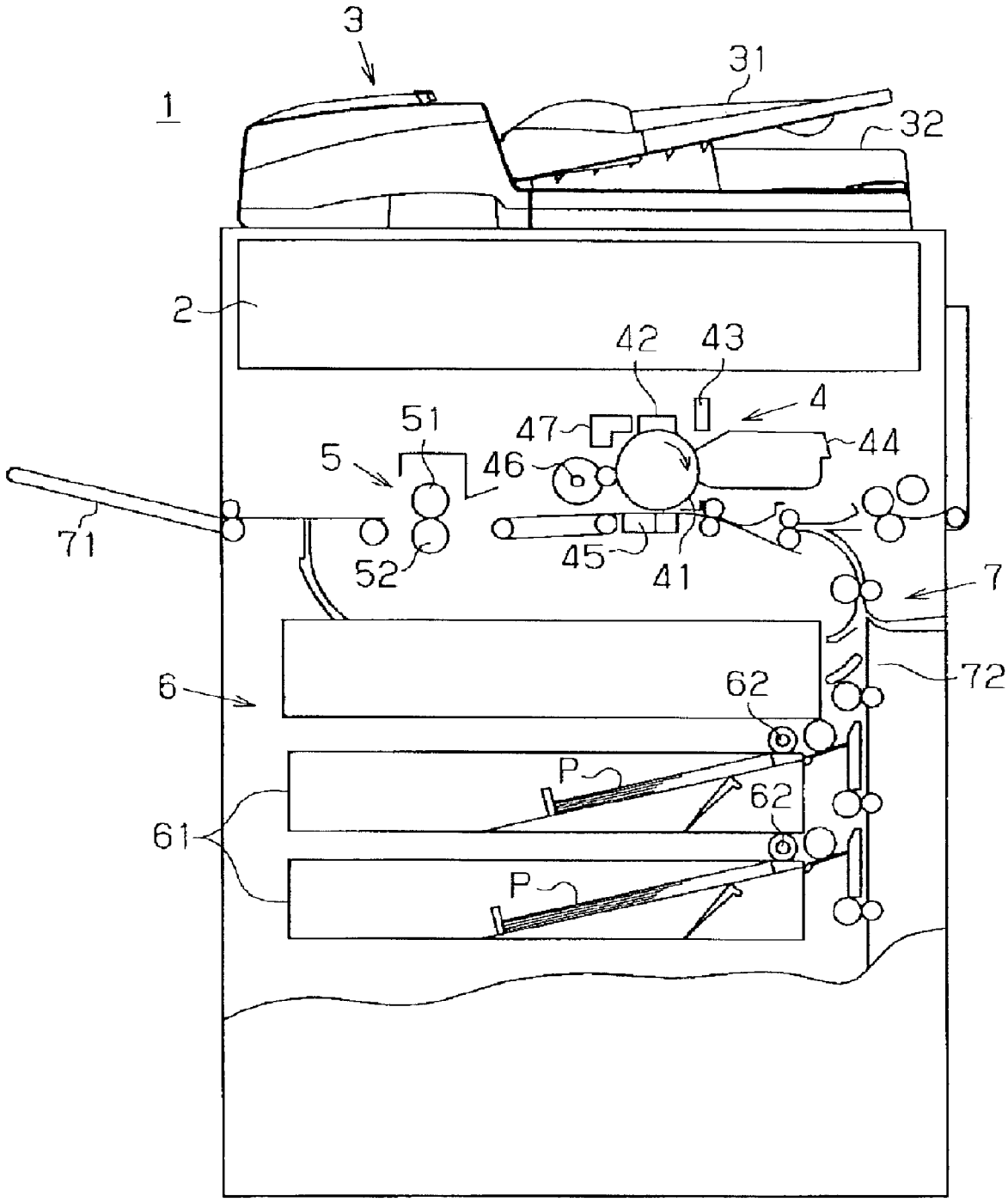
FIG. 1 is a schematic block diagram that shows the schematic construction of an image forming device (copying machine) in which an embodiment of the present invention is applied.

A detailed description is given hereinafter of the preferred embodiment of the present invention with reference to FIG. 1. FIG. 1 is a diagram that shows a schematic construction of an image forming device (copying machine) 1 according to an embodiment of the present invention.

The copying machine 1, as shown in FIG. 1, comprises an original document feeding device 3 that automatically feeds an original document to image reading means 2, image reading means 2 that reads the image data of the original document, image forming means 4 that forms the image read by the image reading means 2 onto paper P, fusing means 5, and a paper supply unit 6 that stores the paper P. Paper feeding means 7 is also provided in order to feed the paper P to a discharge unit 71 through the image forming means 4 and the fusing means 5.

The image reading means 2 reads image data from an original document by irradiating light from an exposure lamp onto an original document placed on a contact glass, and guiding a beam via a reflecting mirror to a photoelectric converter comprised of a CCD sensor.

The original document feeding device 3 comprises an original document placement platform 31 for placing an original document, an original document paper supply unit that supplies the original document placed on the original document placement platform 31, an original document paper supply feeding path for feeding the supplied original document, and an original document discharge unit 32 for discharging the original document after reading is completed.

The paper supply unit 6 comprises a plurality of paper supply cassettes 61 which store paper P, and discharges paper P by means of the rotation of a paper supply roller 62 toward the paper feeding means 7 from one of the plurality of paper supply cassettes 61. Through this construction, one sheet of paper P at a time is reliably supplied to the paper feeding means 7. Moreover, the paper supply cassettes 61 can be freely attached and removed from the copying machine 1.

The paper P supplied to the paper feeding means 7 is fed to the image forming means 4 through a paper supply path 72. The image forming means 4 forms a toner image on paper P by an electrophotographic process, has a photoreceptor 41 (which is an image carrier) arranged on a shaft with the ability to rotate in a predetermined direction (the direction indicated by the arrow in the drawing). An electrostatic charging device 42, photo exposing device 43, development device 44, transfer device 45, cleaning device 46, and static eliminator device 47, are arranged near the photoreceptor 41 along the rotation direction thereof.

The electrostatic charging device 42 provides an electrostatic wire impressed with a high voltage, and a predetermined electric potential is applied to the surface of the photoreceptor 41 by a corona discharge from the electrostatic wire. The surface of the photoreceptor 41 is electrically charged uniformly in this manner. Through the photo exposing device 43, light based on image data of an original document read by the image reading means 2 is irradiated onto the photoreceptor 41. The electric potential on the surface of the photoreceptor 41 is thereby selectively attenuated, forming an electrostatic latent image on the surface of the photoreceptor 41. Next, toner is adhered to the electrostatic latent image by the development device 44, forming a toner image on the surface of the photoreceptor 41. The toner image on the surface of the photoreceptor 41 is transferred by the transfer device 45 to the paper P supplied between the photoreceptor 41 and the transfer device 45.

The paper P onto which a toner image has been transferred is fed to the fusing means 5 from the image forming means 4. The fusing means 5 is placed on the down stream side of the paper feed direction of the image forming means 4. The paper P is then heated and held between a heating roller 51 attached to the fusing means 5 and a pressure roller 52 held down by the heating roller 51, and the toner image is fused to the paper P. The paper P having undergone image formation in this manner is discharged onto the discharge unit 71. Meanwhile, the residual toner on the surface of the photoreceptor 41 is then removed by the cleaning device 46, and the residual electric charge on the surface of the photoreceptor 41 is removed by the static eliminator device 47. The photoreceptor 41 is re-charged by the electrostatic charging device 42, and image formation can be performed thereafter in the same manner.

Figure 2:
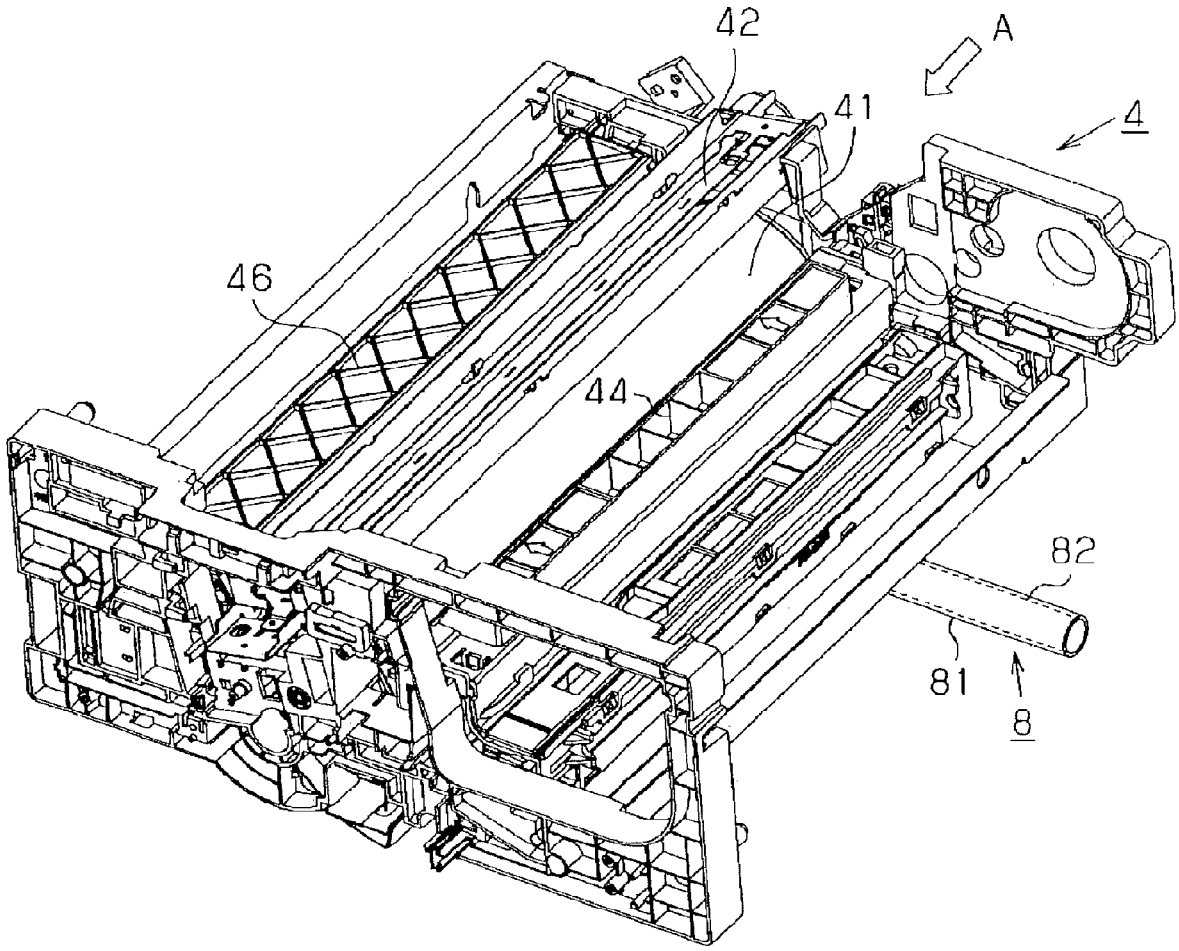
FIG. 2 is a perspective view that shows the schematic construction of image forming means in the copying machine according to an embodiment of the present invention.
Figure 3:
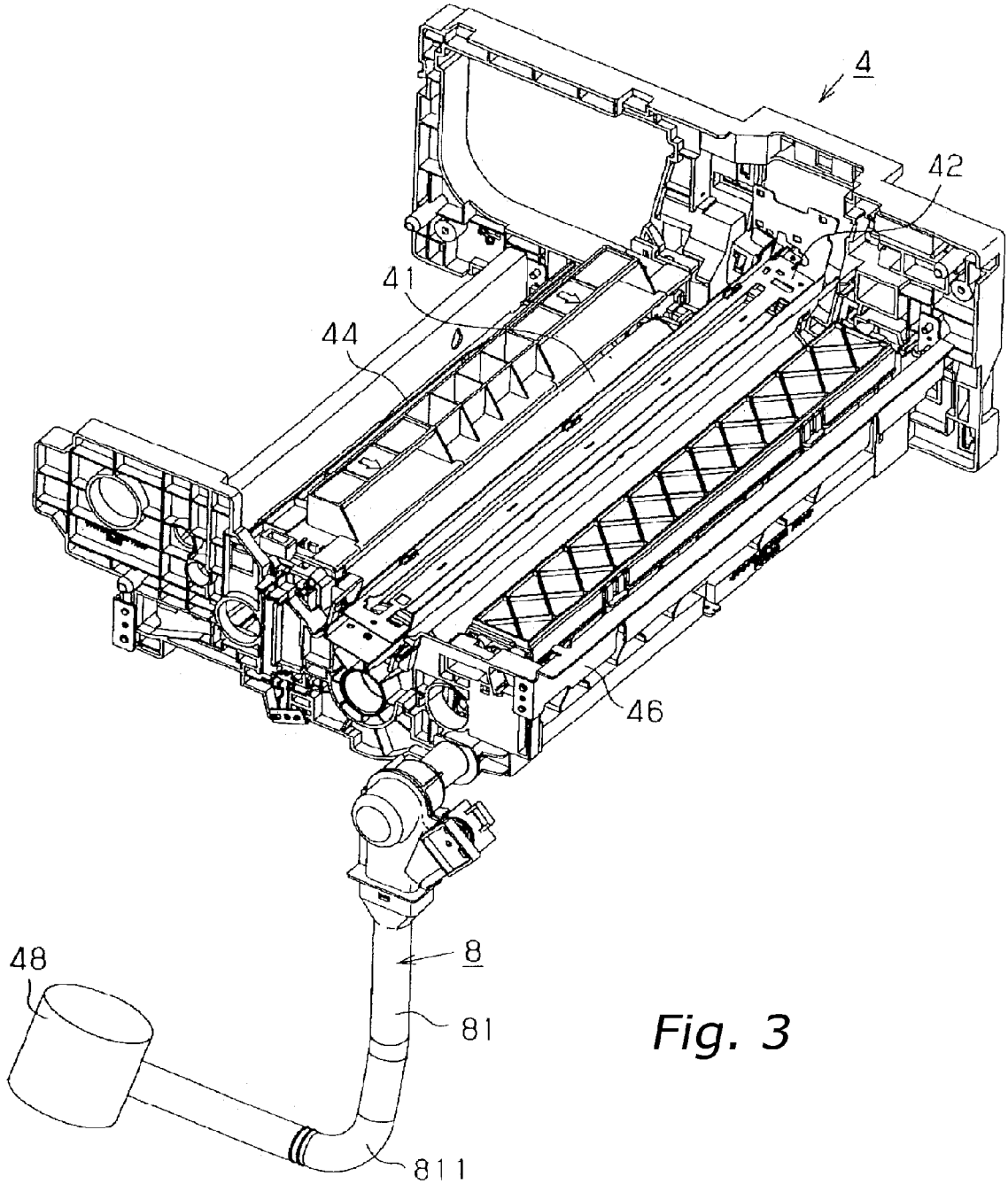
FIG. 3 is a perspective view of the image forming means shown in FIG. 2 as viewed from the arrow A direction.
Figure 4:
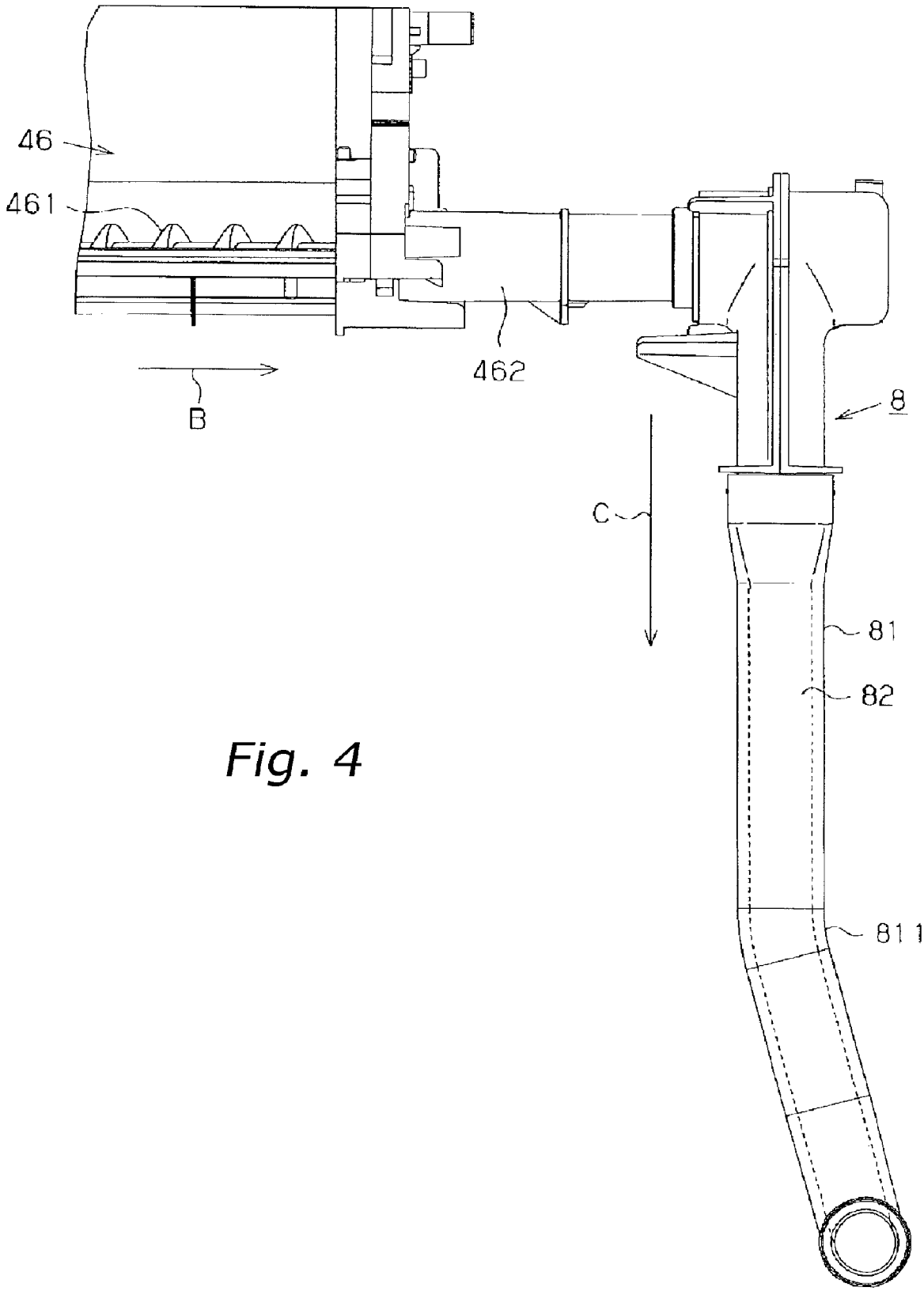
FIG. 4 is a partial cross-sectional view showing a cleaning device and a toner delivery mechanism.

Next, a description will be given of a toner delivery mechanism 8 with reference to the drawings. FIG. 2 is a perspective view of the schematic construction of the image forming means 4, FIG. 3 is a perspective view of the image forming means 4 shown in FIG. 2 as viewed from the arrow A direction, and FIG. 4 is a partial cross-sectional drawing showing the cleaning device 46 and the toner delivery mechanism 8. As shown in the drawings, the toner delivery mechanism 8 according to the present embodiment delivers toner from the cleaning device 46 to a toner collection receptacle 48, and comprises a collection pipe 81 having a curved part 811, and a collection spiral 82 driven to rotate by a drive source not shown in the drawing. The collection pipe 81 is formed from synthetic rubber such as urethane or the like. Further, the collection spiral 82 is formed by working a suitable metal wire, such as a stainless steel wire, into a coil shape.

The cleaning device 46 removes the residual toner that remains on the surface of the photoreceptor 41 after image transfer by the action of a cleaning blade (not shown in the drawing). The toner removed from the surface of the photoreceptor 41 is moved toward a feed roller 461, which includes a spiral roller having spiral blades on a rotating shaft. The toner is delivered in the direction shown by arrow B by the action of the spiral blades through a connection pipe 462, and delivered to the toner delivery mechanism 8 by the rotation of the feed roller 461. Further, the toner delivered to the toner delivery mechanism 8 is delivered in the direction shown by arrow C within the collection pipe 81, and collected at the toner collection receptacle 48 by the action of the rotating collection spiral 82.

Figure 5:
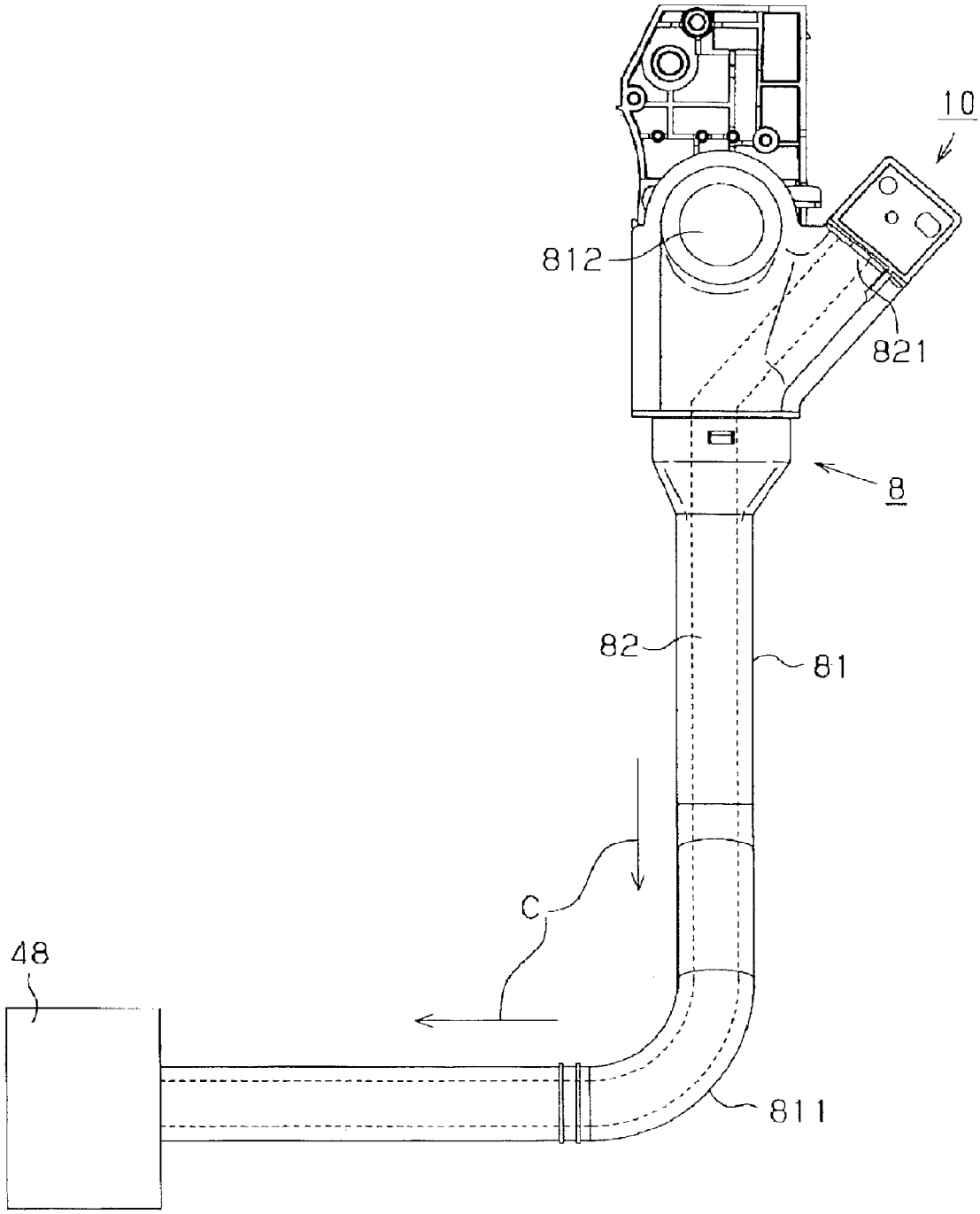
FIG. 5 is a side view of the toner delivery mechanism shown in FIG. 3.
Figure 6:
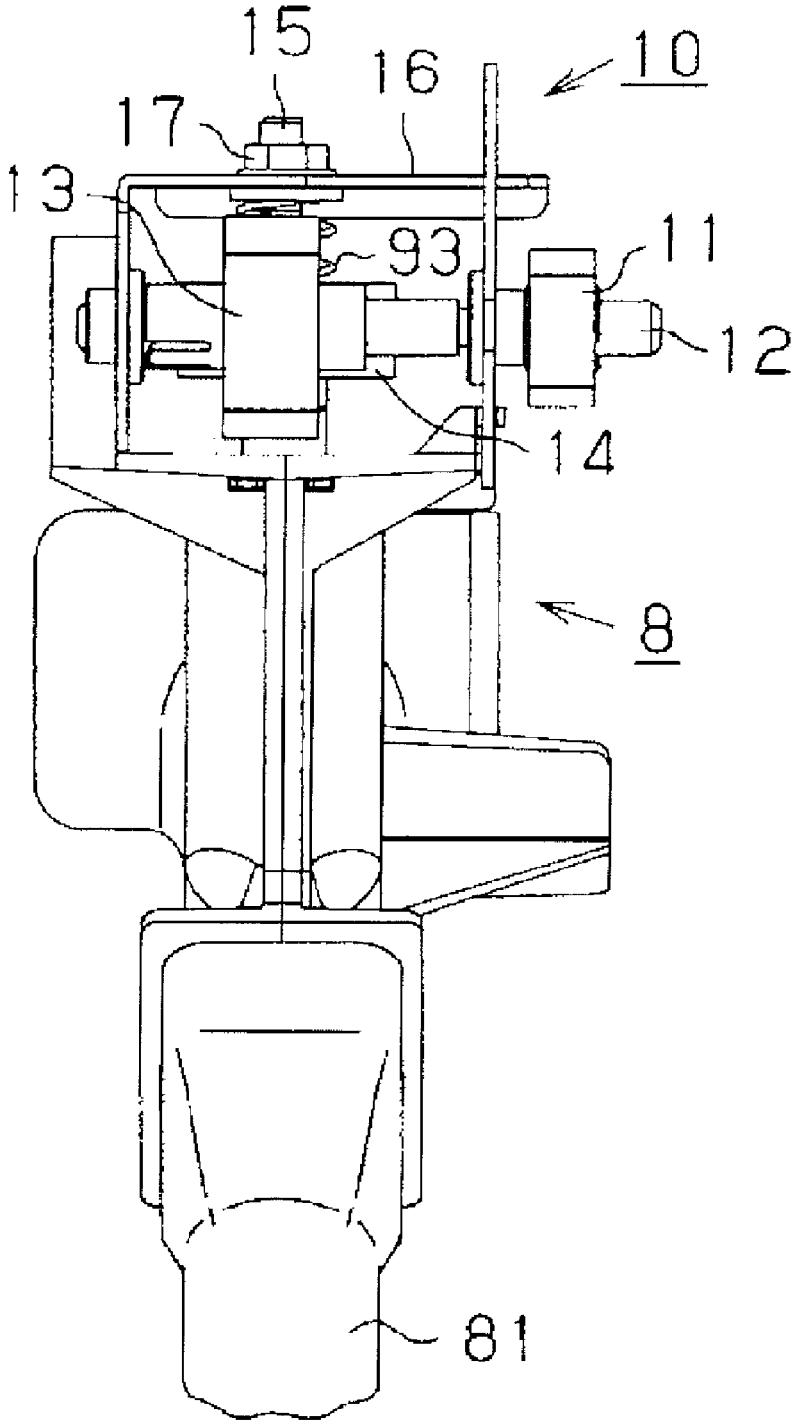
FIG. 6 is a front view of the toner delivery mechanism shown in FIG. 3.
Figure 7:
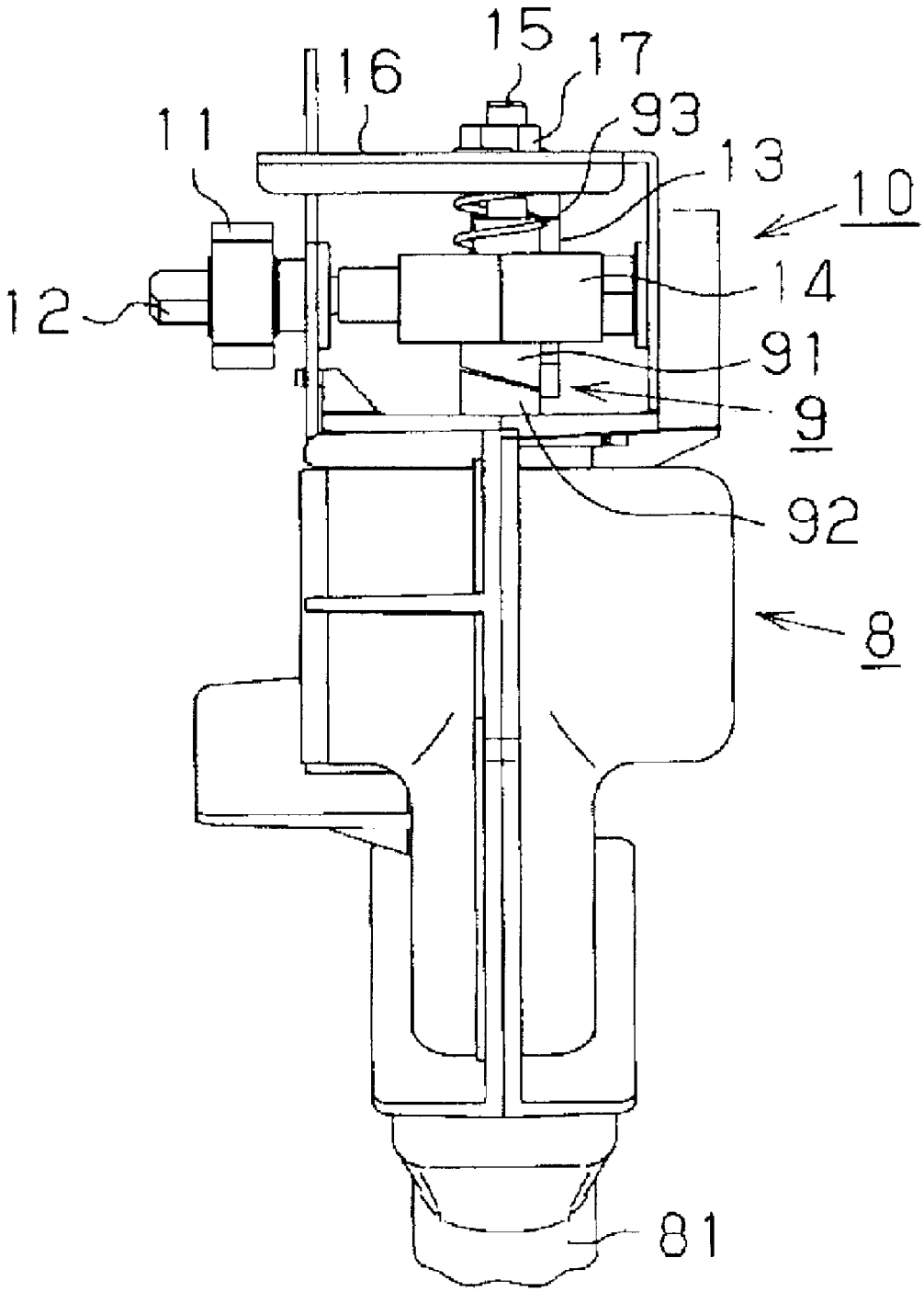
FIG. 7 is a rear view of the toner delivery mechanism shown in FIG. 3.
Figure 8:
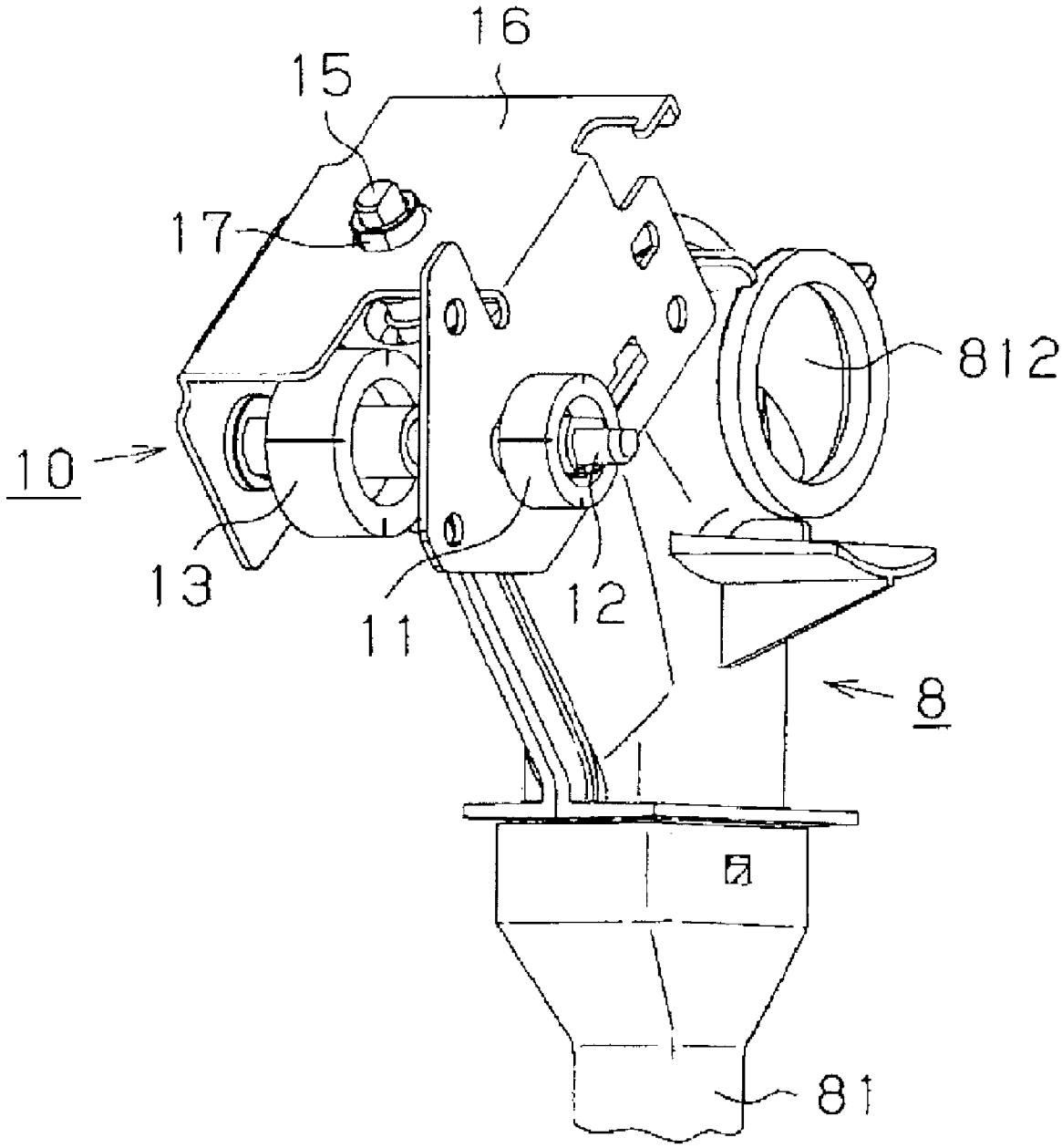
FIG. 8 is a perspective view of the toner delivery mechanism shown in FIG. 3 as viewed from the front.
Figure 9:
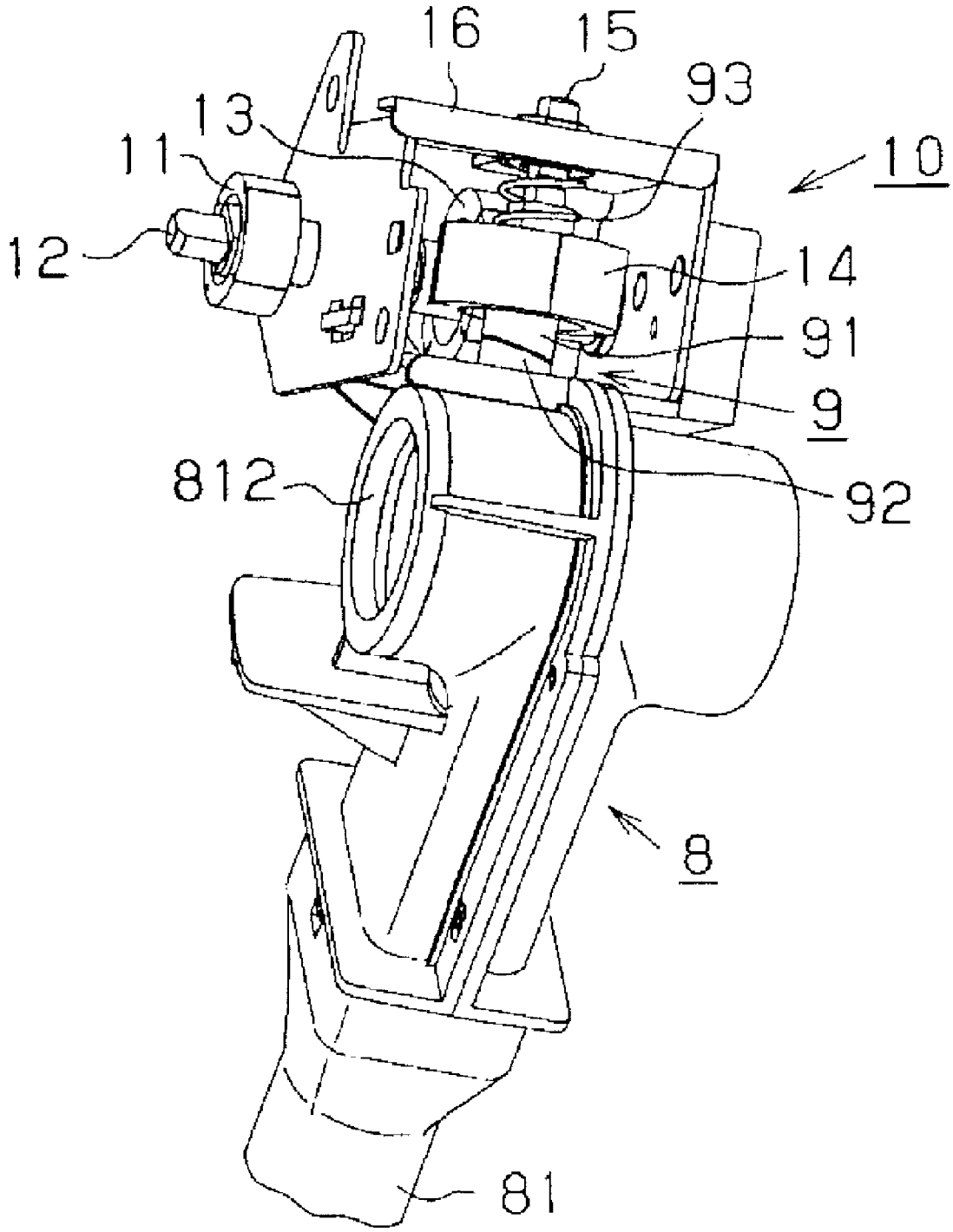
FIG. 9 is a perspective view of the same toner delivery mechanism shown in FIG. 3 as viewed from the back.
Figure 10:
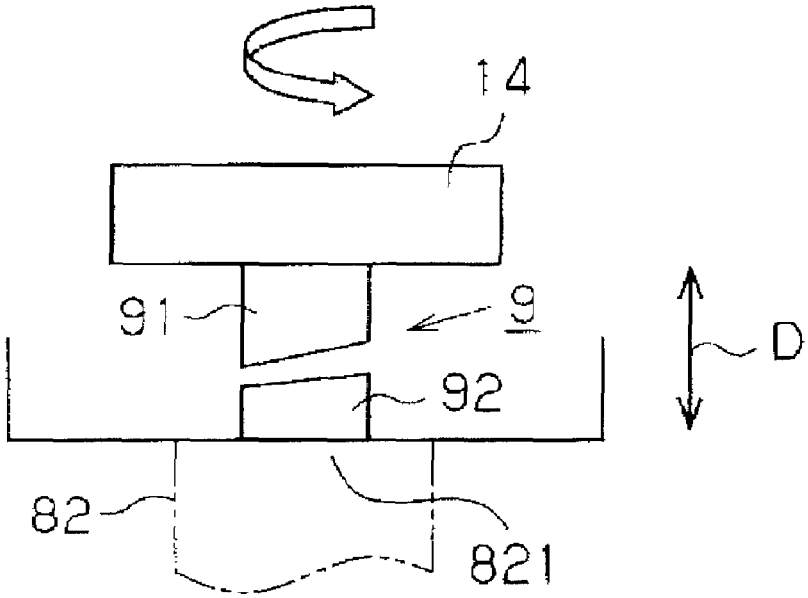
FIG. 10 is a schematic view for explaining an example of a cam mechanism used in an embodiment of the present invention.
Figure 11:
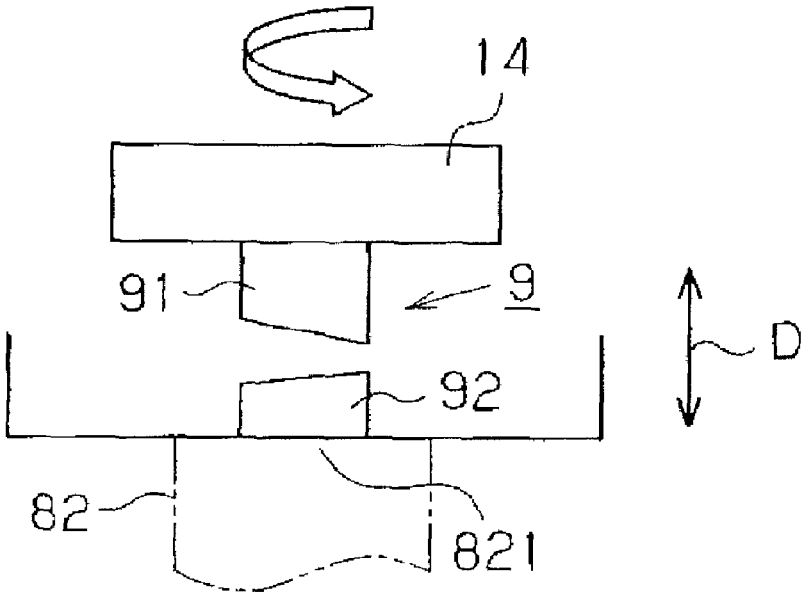
FIG. 11 is a schematic view for explaining the example of the cam mechanism shown in FIG. 10.

Next, a detailed description is given, based on FIG. 5 through FIG. 11, of the construction of the collection spiral 82 that can reciprocate in the toner delivery direction in conjunction with drive rotation. FIG. 5 is a side view of the toner delivery mechanism 8 shown in FIG. 3; FIG. 6 is a front view of the toner delivery mechanism 8 shown in FIG. 3; FIG. 7 is a rear view of the same toner delivery mechanism 8 shown in FIG. 3. FIG. 8 is a perspective view of the toner delivery mechanism 8 shown in FIG. 3 as viewed from the front; FIG. 9 is a perspective view of the toner delivery mechanism 8 shown in FIG. 3 as viewed from the back. FIG. 10 and FIG. 11 are schematic drawings for explaining one example of a cam mechanism 9 used in the present embodiment.

As shown in FIG. 5 through FIG. 9, a drive transmitting unit 10 is attached to the toner delivery mechanism 8 at, for example, the upstream side of the collection pipe 81. The drive transmitting unit 10 has the cam mechanism 9 that allows the collection spiral 82 to reciprocate in the toner delivery direction (arrow C direction in FIG. 4 and FIG. 5). The drive transmitting unit 10 comprises a gear 11 on the input side energized by the driving force of a drive source not shown in the drawing, a shaft 12 that transmits the rotation of the gear 11, a first transmission gear 13 attached to the shaft 12, a second transmission gear 14 that meshes with the gear 13, and a rotation shaft 15 that rotates by means of the gear 14. One end of the rotation shaft 15 is attached to a bearing 17 arranged on a frame 16 of the drive transmitting unit 10, and the other end is attached to a tip end 821 of the collection spiral 82 by a securing means (not shown in the drawing). The collection spiral 82, according to this construction, rotates in conjunction with the rotation shaft 15 when the gear 11 on the input side rotates, thereby transmitting the rotational force from the gear 11 and through the gear 12, gear 13, gear 14, and the rotation shaft 15.

The cam mechanism 9 comprises, for example, a cam 91 rotated by the rotation of the second transmission gear 14, and a shaft 92 connected to the cam 91 and which travels vertically by the rotation of the cam 91. The cam 91 has a tilted surface that tilts in the toner delivery direction. In other words, the cam 91 is a swash plate cam. Further, the shaft 92 is connected to one end of the collection spiral 82. In addition, a compression spring 93 is arranged between the second transmission gear 14 and the inner wall of the frame 16 so as to brace the rotation shaft 15, and the cam mechanism 9 is urged to the second transmission gear 14 side by the compression spring 93. Moreover, the rotation shaft 15 is embedded so as to rotate as one unit with the second transmission gear 14 and the cam 91, and it passes through the inside of the shaft 92. With this construction, the cam 91 rotates in conjunction with the rotation of the gear 14, and the shaft 92 that contacts with the cam 91 travels in both directions in the arrow D direction as shown in FIG. 10 and FIG. 11. In this way, the collection spiral 82 reciprocates in the toner delivery direction (arrow C direction, see FIG. 5) in conjunction with the rotation described above.

The toner collected by the cleaning device 46, according to this construction, is delivered from a delivery opening 812 of the toner delivery mechanism 8 to the collection pipe 81, and is thereby smoothly delivered to the toner collection receptacle 48 by the rotation of the collection spiral 82 and the travel in both directions in the toner delivery direction.

The collection spiral 82, according to the present embodiment with the construction described above, does not contact with the same part of the inner wall surface of the collection pipe 81 because it travels in both directions while rotating. The fear of damaging a specific part of the collection pipe 81 as done with the conventional method is therefore alleviated, thereby enabling a longer life span for the toner delivery mechanism 8. Also, since the collection pipe 81 and the collection spiral 82 can be arranged reciprocably in any toner delivery direction, the construction is quite easy.

Further convenience is possible as considerations do not have to be made for the shape of the collection pipe 81, and the placement construction of the cleaning device 46 and the toner collection receptacle 48, because a longer life span can be provided for the toner delivery mechanism 8, even when there is a curved portion 811 as described above between the cleaning device 46 and the toner collection receptacle 48.

In addition, not only can the rotation driving force be transmitted to the collection spiral 82 by the drive transmitting unit 10 having the cam mechanism 9, but because it is made to travel in both directions, a longer life span can be provided for the toner delivery mechanism 8 with a simple construction.

A copying machine is used as an example above, however the present invention can also be applied to a facsimile machine, as well as to a multi-function device providing various functions such as a copying function, printing function, scanning function, and facsimile function.

Further, a photoreceptor 41 in the shape of a drum is used in the present embodiment, however the photoreceptor 41 is not limited to this shape, and any known shape other than the drum shape given above may also be used. A sheet shape, belt shape, and web shape can be given as examples.

A tilted cam is used as the cam mechanism 9 in the present embodiment given above, however any cam mechanism such as a circular cam, cylindrical cam, or a positive motion cam can of course be used.

A construction is further possible in which the collection spiral 82 reciprocates in the toner delivery direction in conjunction with rotation by another transmitting mechanism, regardless of the cam mechanism 9.

The present invention described above provides a toner delivery mechanism that enables a long life span to be provided with a simple construction.

Any terms of degree used herein, such as "substantially", "about" and "approximately", mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application No. 2005-008079. The entire disclosure of Japanese Patent Application No. 2005-008079 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A toner delivery mechanism arranged between a cleaning device for cleaning residual toner on an image carrier, and a toner collection receptacle for collecting residual toner, comprising:

collection pipe means arranged between the cleaning device and the toner collection receptacle;

collection spiral means for extending within the collection pipe means, and delivering toner by means of rotation;

rotation drive means for rotating the collection spiral means, and reciprocating means for reciprocating the collection spiral means in a toner delivery direction, the reciprocating means for reciprocating the collection spiral means in conjunction with the rotation of the collection spiral means by means of the rotation drive means.

2. The toner delivery mechanism according to claim 1, further comprising single drive means for storing the rotation drive means and the reciprocating means.

3. The toner delivery mechanism according to claim 2, wherein the reciprocating means has cam means for rotating by means of the rotation drive means, the cam means having a tilted surface that tilts in the toner delivery direction of the collection spiral means, and shaft means connected to the collection spiral means, the shaft means for reciprocating in the toner delivery direction of the collection spiral means by contacting the tilted surface of the cam means.

4. An image forming device, comprising:

image forming means for forming a toner image on paper, the image forming means having an image carrier on the surface of which a toner image will be formed;

paper supply means for supplying paper to the image forming means;

cleaning means for cleaning residual toner on the image carrier;

toner collection means for storing the residual toner collected by the cleaning means;

toner delivery means arranged between the cleaning means and the toner collection means; and toner delivery means, having collection pipe means arranged between the cleaning means and the toner collection means, collection spiral means for extending within the collection pipe means, and delivering toner by means of the rotation thereof, rotation drive means for rotating the collection means, reciprocating means for reciprocating the collection spiral means in a toner delivery direction, the reciprocating means for reciprocating the collection spiral means in conjunction with the rotation of the collection spiral means by means of the rotation drive means.

5. The image forming device according to claim 4, further comprising a single drive means for storing the rotation drive means and the reciprocating means.

6. The image forming device according to claim 4, wherein the reciprocating means has cam means for rotating by means of the rotation drive means, the cam means having a tilted surface that tilts in the toner delivery direction of the collection spiral means, and shaft means connected to the collection spiral means, the shaft means for reciprocating in the toner delivery direction of the collection spiral means by contacting the tilted surface of the cam means.

7. A toner delivery mechanism arranged between a cleaning device for cleaning residual toner on an image carrier, and a toner collection receptacle for collecting residual toner, comprising:

a collection pipe being arranged between the cleaning device and the toner collection receptacle;

a collection spiral extending within the collection pipe, and delivering toner by rotation;

a rotation drive mechanism being configured to rotate the collection spiral; and a reciprocating mechanism being configured to reciprocate the collection spiral in a toner delivery direction, the reciprocating mechanism configured to reciprocate the collection spiral in conjunction with the rotation of the collection spiral by the rotation drive mechanism.

8. The toner delivery mechanism according to claim 7, further comprising a single drive unit that stores the rotation drive mechanism and the reciprocating mechanism.

9. The toner delivery mechanism according to claim 8, wherein the reciprocating mechanism comprises a cam that rotates by the rotation drive mechanism, the cam having a tilted surface that tilts in the toner delivery direction of the collection spiral, and a shaft connected to the collection spiral, the shaft reciprocates in the toner delivery direction of the collection spiral by contacting the tilted surface of the cam.

10. An image forming device, comprising:

an image forming unit being configured to form a toner image on paper, the image forming unit having an image carrier on the surface of which a toner image is formed;

a paper supply unit being configured to supply paper to the image forming unit;

a cleaning device being configured to clean residual toner on the image carrier;

a toner collection receptacle being configured to store the residual toner collected by the cleaning device; and a toner delivery mechanism being arranged between the cleaning device and the toner collection receptacle, the toner delivery mechanism having a collection pipe being arranged between the cleaning device and the toner collection receptacle, a collection spiral extending within the collection pipe, and delivering toner by the rotation thereof, rotation drive mechanism being configured to rotate the collection spiral, and reciprocating mechanism being configured to reciprocate the collection spiral in a toner delivery direction, the reciprocating mechanism being configured to reciprocate the collection spiral in conjunction with the rotation of the collection spiral by means of the rotation drive mechanism.

11. The image forming device according to claim 10, further comprising a single drive unit that stores the rotation drive mechanism and the reciprocating mechanism.

12. The image forming device according to claim 9, wherein the reciprocating mechanism has a cam that rotates by means of the rotation drive mechanism, the cam having a tilted surface that tilts in the toner delivery direction of the collection spiral, and a shaft connected to the collection spiral, the shaft capable of reciprocating in the toner delivery direction of the collection spiral by contacting the tilted surface of the cam.

* * * * *